US005425887A

United States Patent [19]

Lam et al.

[11] Patent Number: 5,425,887

[45] Date of Patent: Jun. 20, 1995

[54] ENCAPSUALTED PERFUME IN FABRIC CONDITIONING ARTICLES

[75] Inventors: Andrew C. Lam, Yorktown, N.Y.; Liang S. Tsaur, Norwood, N.J.; Samuel Q. Lin, Paramus, N.J.; Hifzur R. Ansari, Old Tappan, N.J.

[73] Assignee: Lever Brothers Company, Division of Conopco, Inc., New York, N.Y.

[21] Appl. No.: 97,791

[22] Filed: Jul. 26, 1993

[51] Int. Cl.[6] ..... D06M 23/02; D06M 13/07; D06M 13/46

[52] U.S. Cl. ..... 252/8.6; 252/8.8; 252/8.7; 252/8.75; 252/8.9; 428/260; 428/262; 428/279

[58] Field of Search ..... 252/8.6, 8.7, 8.75, 252/8.8, 8.9; 428/260, 262, 279

[56] References Cited

U.S. PATENT DOCUMENTS

| | | | |
|---|---|---|---|
| 3,821,436 | 6/1974 | Fry | 426/213 |
| 3,943,063 | 3/1976 | Morishita et al. | 252/316 |
| 4,076,633 | 2/1978 | Edwards et al. | 252/8.75 |
| 4,134,838 | 1/1979 | Hooper et al. | 252/8.8 |
| 4,137,180 | 1/1979 | Naik et al. | 252/8.8 |
| 4,276,312 | 6/1981 | Merritt | 426/96 |
| 4,322,308 | 3/1982 | Hooper et al. | 252/107 |
| 4,511,495 | 4/1985 | Melville et al. | 252/8.6 |
| 4,536,315 | 8/1985 | Ramachandran | 252/8.8 |
| 4,767,547 | 8/1988 | Straathof et al. | 252/8.8 |
| 4,789,491 | 12/1988 | Chang et al. | 252/8.75 |
| 4,908,233 | 3/1990 | Takizawa et al. | 427/213.35 |
| 4,954,285 | 9/1990 | Wierenga et al. | 252/174.11 |
| 5,102,564 | 4/1992 | Gardlik et al. | 252/8.9 |
| 5,112,688 | 5/1992 | Michael | 252/8.6 |
| 5,174,911 | 12/1992 | Lin et al. | 252/8.6 |
| 5,246,603 | 9/1993 | Tsaur et al. | 252/8.75 |

FOREIGN PATENT DOCUMENTS

| | | |
|---|---|---|
| 0392606 | 10/1990 | European Pat. Off. . |
| 0392607 | 10/1990 | European Pat. Off. . |
| 0397245 | 11/1990 | European Pat. Off. . |
| 0397246 | 11/1990 | European Pat. Off. . |
| 0480520 | 4/1992 | European Pat. Off. . |
| 91/17300 | 11/1991 | WIPO . |

*Primary Examiner*—Anthony Green
*Assistant Examiner*—C. M. Bonner
*Attorney, Agent, or Firm*—A. Kate Huffman

[57] ABSTRACT

A tumble dryer article comprising an effective amount of a fabric conditioning composition containing from about 60 to about 99 wt. % of a hydrocarbon based fabric conditioning component a) an effective amount of a fabric conditioning composition having (i) from about 60 to about 99 wt. % of a hydrocarbon based fabric conditioning component; and (ii) 0.5 wt. % to 30 wt. % perfume capsules consisting essentially of a water soluble natural or modified natural or synthetic polymer and 1% to 70% perfume, the fabric conditioning composition having 10 wt. % or less free water when 0.5 wt. % to 10 wt. % perfume capsules are present and a free water to perfume capsules ratio of less than about 1 when more than 10 wt. % perfume particles are present; and b) dispensing means for dispensing the fabric conditioning composition onto fabrics in a tumble dryer.

10 Claims, No Drawings

ENCAPSUALTED PERFUME IN FABRIC CONDITIONING ARTICLES

FIELD OF THE INVENTION

This invention pertains to fabric conditioning articles containing encapsulated perfume for extended fragrance deliverance out of a tumble dryer.

BACKGROUND OF THE INVENTION

Fragrances have long been used to provide a pleasing scent to tumble dried fabrics as well as to mask or reduce malodors of fabric conditioning agents used in tumble dryer articles.

The harsh conditions of manufacturing such articles as well as dryer times and temperatures are deleterious to volatile perfume notes. Much of the perfume added to the fabric conditioning compositions is lost prior to removing dried fabrics from the tumble dryer.

Many techniques have been tried to entrap the volatile fragrance oil to enhance its deposition on dried fabrics and to extend its fragrance upon use or wear. Such prior art techniques involve encapsulating perfume oils in cyclodextrin complex carriers as illustrated in EP 392,607, EP 392,606 and WO 9117300. Although the use of cyclodextrin complexes is technically sound, the materials are expensive and add an undesirable upcharge to manufacturing cost.

Water insoluble polymeric carriers have been used to encapsulate perfumes used in fabric conditioners as described in U.S. Pat. Nos. 4,076,633; EP 397,246; and EP 397,245. Such carriers are impervious to water and release perfume upon heat activation. Extended release of the perfume through use or wear is therefore generally not achieved when such carriers are used.

Perfumes have also been adsorbed onto various materials such as silica and clay to deliver perfume in detergents and fabric softeners as illustrated in U.S. Pat. No. 4,954,285 issued to Wierenga et al. and U.S. Pat. No. 4,536,315. In general, the fragrance oil is not sufficiently protected so that it is frequently lost or destabilized during processing.

Water soluble polymers have been used to encapsulate fragrance oils as described in U.S. Pat. Nos. 4,276,312; 3,821,436 and EP 480 520. Such capsules have proved useful in releasing perfume in deodorant applications, however, have not been commercially successful in extended release of perfume from fabrics dried in tumble dryers.

It is thus an object of the present invention to provide a tumble dryer article containing encapsulated perfume capsules which will prevent the loss of the majority of the fragrance oil during processing, storage and use of the fabric conditioning articles and at the same time will release the majority of the fragrance onto dried fabrics during their use or wear.

Another object of the invention is to provide an extended release of perfume onto dried fabrics in response to an aqueous trigger.

SUMMARY OF THE INVENTION

The present invention relates to tumble dryer articles having a fabric conditioning composition contained in or applied onto a dispensing means. The fabric conditioning composition comprises an effective amount of a fabric conditioning agent and about 0.5 wt. % to about 30 wt. % perfume encapsulates preferably about 5 to about 20 wt. %, most preferably about 5 to about 10 wt. %. The encapsulating material is a water soluble natural or synthetic polymer with a molecular weight of less than about 300,000. In the preferred embodiment the fabric conditioning compositions contain less than about 10% wt. perfume capsules and less than about 10% free water, preferably less than about 5 wt. % free water added. The preferred dispensing means is a flexible sheet.

DETAILED DESCRIPTION OF PREFERRED EMBODIMENTS

The compositions of the invention combine perfume capsules with fabric conditioning agents to form compositions which are applied or added to a dispensing means. The fabric compositions contain about 0.5 wt. % to about 30 wt. % perfume capsules, preferably 5 to about 20 wt. %, most preferably about 5 to about 10 wt. % capsules. If the fabric compositions contain about 10 wt. % or less perfume particles, the amount of free water present in the compositions should be less than about 10%, preferably less than about 5 wt. %, most preferably less than about 3 wt. % free water. If more than 10 wt. % perfume capsules are included the amount of free water present in the compositions is in a weight ratio of less than about 1 free water to perfume capsules.

Free water is defined as water which is added to the fabric conditioning composition and is not introduced into the composition with components of the composition as bound or associated water molecules.

The perfume capsules are prepared with a water soluble polymer which dissolves or disintegrates to release perfume fragrance when triggered by water or moisture. Specifically, when the perfume capsules are contacted with about five times their weight of water, each capsule dissolves or disintegrates to an extent to release more than about 30%, preferably more than about 50% relative to the release of perfume from non-encapsulated perfume at ambient temperature within 15 minutes. The amount of perfume released upon contact with water in a given amount of time can be determined by using a gas chromatography method utilizing a purge and trap device as known in the art and described in the following examples.

Without being limited by theory, it is believed that the ratio of the water soluble materials of the capsules to free water in the compositions prevents the materials from coming in contact with more than five times their weight of water. Thus the capsules retain a majority of their perfume throughout the manufacturing and drying processes for release upon subsequent wetting during use or wear. A protective coating provided by the fabric conditioning agent itself further prevents dissolution of the capsule material. Water soluble polymers which are suitable for use in the claimed composition include both natural or modified natural polymers and synthetic polymers, each polymer having a molecular weight of less than about 300,000.

Examples of water soluble natural and modified natural polymers are starch, gums and gelatin. Modified starch in its myriad of forms, including dextrins, is useful within the invention, as well as hydrolyzed gums and hydrolyzed gelatin. Hydrophobically modified starches useful within the scope of the invention are described in U.S. Pat. No. 3,159,585 assigned to National Starch and Chemical Corporation of Bridgewater, N.J. and U.S. Pat. No. 3,091,567, herein incorporated by reference.

Suitable hydrolyzed gums within the invention include gum arabic, starch, pectin, tragacanth, locust bean, guar, alginates, carrageenans, cellulose gums such as carboxymethyl cellulose and karaya.

Preferred hydrolyzed starches are those having a dextrose equivalent of 0.25 up to about 20, preferably 5 to 15. Hydrolyzed starch having DE above about 20 does not appear to be suitable since products made therewith have a higher loss of the active material, are hygroscopic and consequently have a tendency to agglomerate. At the lower extreme is any hydrolyzed starch having a detectable DE.

A wide range of starch hydrolysis having dextrose equivalents of up to 95 are also useful. Until recently these starch hydrolysates, also called maltodextrins and dextrins were produced from various starches by acid hydrolysis. The hydrolysates resulting from this acid process are not completely soluble in water, and contain native starch. Suitable starches are derived from corn, waxy maize, tapioca, etc. See U.S. Pat. No. 4,276,312, column 4, line 54 - column 5, line 24, herein incorporated by reference.

Examples of water soluble hydroxyalkyl and carboxyalkyl celluloses include hydroxyethyl and carboxymethyl cellulose, hydroxyethyl and carboxyethyl cellulose, hydroxymethyl and carboxymethyl cellulose, hydroxypropyl carboxymethyl cellulose, hydroxypropyl methyl carboxyethyl cellulose, hydroxypropyl carboxypropyl cellulose, hydroxybutyl carboxymethyl cellulose, and the like. Also useful are alkali metal salts of these carboxyalkyl celluloses, particularly and preferably the sodium and potassium derivatives.

Examples of synthetic water soluble polymers which are useful for the invention include polyvinyl pyrrolidone, water soluble celluloses, polyvinyl alcohol, ethylene maleic anhydride copolymer, methylvinyl ether maleic anhydride copolymer, polyethylene oxides, water soluble polyamide or polyester.

Especially preferred starches useful for the perfume coating include Purity Gum Be starch supplied by National Starch and Chemical Corporation of Bridgewater, N.J. and a modified food starch supplied under the trademark Capsule also supplied by National Starch and Chemical Corporation.

The perfume capsules may be prepared by either a spray drying process or a coacervation process as known in the art. It is understood that any other process known in the art may be used to provide the capsules useful for the invention.

A spray drying process which is useful is described in U.S. Pat. No. 3,455,838, herein incorporated by reference. Specifically, the water soluble polymers are dispersed or dissolved in water to form a solution having a pH level preferably in the range of from about 2 to 8. Preferably, the water bath has been heated to a temperature from about 100° F. to 210° F. before the addition of the polymer. Once the solution is complete, the perfume is slowly added and the mixture is rapidly agitated until such time as emulsification is complete.

The resulting emulsion may then be dried by any suitable means, preferably by spray drying. The preferred spray drying technique may be accomplished using any commercially available spray drying equipment capable of providing an inlet temperature in the range of approximately 212° F. to 520° F.

The coacervation process used for preparing the capsules is described in U.S. Pat. No. 4,908,233 and U.S. Pat. No. 3,943,063, herein incorporated by reference.

In the coacervation method, the perfume material is dispersed in water which contains a first water soluble polymer selected from the group consisting of polyvinyl alcohol, sulfated cellulose, water soluble nylon, gelatin and poly(meth)acrylic acid and the inorganic or organic salt thereto, and a second water soluble polymer which undergoes substantially no phase separation, with the inorganic or organic salt.

The second coacervation process useful in the invention involves the dispersing or the perfume material in a water soluble polymer solution by emulsifying in fine droplets the solution in a vehicle which is poorly miscible with the solvent of the polymer solution and which does not dissolve the polymer to prepare an emulsion. The emulsion is then added to a non solvent of the polymer which is miscible with the solvent yet poorly miscible with the vehicle and does not dissolve the water soluble polymer. The solvent is removed by being absorbed the nonsolvent emulsion droplets to precipitate the polymer film around the perfume. (See U.S. Pat. No. 3,943,063).

The perfume capsules are relatively small and less than about 100 microns in diameter, preferably about 1 to about 100 microns, and most preferably about 1 to about 40 microns.

Perfume components and mixtures thereof which can be used for the preparation of the perfumes may be natural products such as essential oils, absolutes, resinolds, resins, concretes, etc., and synthetic perfume components such as hydrocarbons, alcohols, aldehydes, ketones, ethers, acids, esters, acetals, ketals, nitriles, etc., including saturated and unsaturated components, aliphatic, carbocyclic and heterocyclic compounds. Examples of such perfume components are: geraniol, geranyl acetate, linalool, linalyl acetate, tetrahydrolinalool, citronellol, citronellyl acetate, dihydromyrcenol, dihydromyrcenyl acetate, tetrahydromyrcenol, terpineol, terpinyl acetate, nopol, nopyl acetate, 2-phenylethanol, 2-phenylethyl acetate, benzyl alcohol, benzyl acetate, benzyl salicylate, benzyl benzoate, styrallyl acetate, amyl salicylate, dimethylbenzyl carbinol, trichloromethylphenyl-carbinyl acetate, p-tert.butyl-cyclohexyl acetate, isononyl acetate, vetiveryl acetate, vetiverol, alpha-n-amylcinammic aidehyde, alpha-hexylcinammic aidehyde, 2-methyl-3-(p-tert.butylphenyl)-propanol, 2-methyl-3-(p-isopropylphenyl)-propanal, 3-(p-tert-.butylphenyl)opropanal, tricyclodecenyl acetate, tricyclodecenyl propionate, 4-(4-hydroxy-4-methylpentyl)-3-cyclohexene carbaldehyde, 4-(4-methyl-3-pentenyl)-3-cyclohexene carbaldehyde, 4-acetoxy-3-pentyletetrahydropyran, methyl-dihydrojasmonate, 2-noheptylcyclopentanone, 3-methyl-2-pentylcyclopentanone, n-decanal, 9-decenol-1, phenoxyethyl isobutyrate, phenylacetaldehyde dimethyl acetal, phenylacetaldehyde diethyl acetal, geranonitrile, citronellonitrile, cedryl acetate, 3-isocamphycyclohexanol, cedryl methyl ether, isolongifolanone, aubepine nitrile, aubepine, heliotropine, coumarin, eugenol, vanillin, diphenyl oxide, hydroxycitronellal, ionones, methylionones, isomethylionones, irones, cis-3-hexenol and esters thereof, indane musk fragrances, tetralin musk fragrances, isochroman musk fragrances, macrocyclic ketones, macrolactone musk fragrances, ethylene brassylate, aromatic nitromusk fragrances.

Especially preferred perfume components include bergamot oil, coriander oil, dimethyl heptanol, dimethyl benzyl carbinyl acetate, geranyl acetate, citronellyl acetate, rose synthetic, geranium bourbon, hedione, iso eugenol, methyl eugenol styrallyl acetate, stemone, rose oxide laevo, aldehyde C-11 undecylic, derivatives of 2,6-dimethyl-2-alkoxy octan-7-ol, vertivert oil, vetiverol, vetiveryl, acetate, quaiac wood oil, esters ol-anthranilic acid, benzyl salicylate, benzyl benzoate, oak moss, eugenol, p-tert-butyl cyclohexyl acetate, coumarin.

Deo fragrance compositions are also useful in the invention such as those described in Hooper et al., U.S. Pat. Nos. 4,134,838 and 4,322,308, herein incorporated by reference.

The perfume is present in the capsules in an amount up to about 70 wt. %, preferably 50 wt. %, most preferably 40 wt. %.

The compositions further contain about 60 to about 99% of a hydrocarbon fabric conditioning active. It is essential that the fabric conditioning composition contains less than about 10% free moisture, more preferably less than about 5wt. %.

FABRIC CONDITIONING COMPONENTS

Hydrocarbon fabric conditioners suitable for use herein are selected from the following classes of compounds:

(i) Cationic quaternary ammonium salts. The counterion is methyl sulfate or any alkyl sulfate or any halide, methyl sulfate being preferred for the dryer-added articles of the invention.

Examples of cationic quaternary ammonium salts include, but are not limited to:

(1) Acyclic quaternary ammonium salts having at least two $C_{8-30}$, preferably $C_{12-22}$ alkyl chains, such as: ditallowdimethyl ammonium methylsulfate, di(hydrogenated tallow)dimethyl ammonium methylsulfate, distearyldimethyl ammonium methylsulfate, dicocodimethyl ammonium methylsulfate and the like;

(2) Cyclic quaternary ammonium salts of the imidazolinium type such as di(hydrogenated tallow)-dimethyl imidazolinium methylsulfate, 1-ethylene-bis(2-tallow-1-methyl) imidazolinium methylsulfate and the like;

(3) Diamido quaternary ammonium salts such as: methyl-bis(hydrogenated tallow amidoethyl)-2-hydroxyethyl ammonium methyl sulfate, methyl bis(tallowamidoethyl)-2-hydroxypropyl ammonium methylsulfate and the like;

(4) Biodegradable quaternary ammonium salts such as N,N-di tallowoyl-oxy-ethyl)-N,N,-dimethyl ammonium methyl sulfate and N,N-di (tallowoyl-oxypropyl)-N,N-dimethyl ammonium methyl sulfate. Biodegradable quaternary ammonium salts are described, for example, in U.S. Pat. Nos. 4,137,180, 4,767,547 and 4,789,491 incorporated by reference herein.

Preferred biodegradable quaternary ammonium salts include the biodegradable cationic diester compounds of the formula:

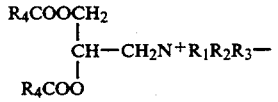

wherein $R_1$, $R_2$ and $R_3$ are each independently selected from $C_{1-4}$ alkyl, a hydroxyalkyl group containing from 1–4 carbon atoms or a benzyl group; each $R_4$ is independently selected from $C_{7-27}$ alkyl or alkenyl groups. (See U.S Pat. No. 4,137,180, herein incorporated be reference).

(ii) Tertiary fatty amines having at least one and preferably two $C_8$ to $C_{30}$, preferably $C_{12}$ to $C_{22}$ alkyl chains. Examples include hardened tallow-di-methylamine and cyclic amines such as 1-(hydrogenated tallow)amidoethyl-2-(hydrogenated tallow)imidazoline. Cyclic amines which may be employed for the compositions herein are described in U.S. Pat. No. 4,806,255 incorporated by reference herein.

(iii) Carboxylic acids having 8 to 30 carbons atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and palmitic acid, and mixtures thereof which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

(v) Fatty alcohols, ethoxylated fatty alcohols, alkylphenols, ethoxylated alkylphenols, ethoxylated fatty amines, ethoxylated monoglycerides and ethoxylated diglycerides.

(vi) Mineral oils, and polyols such as polyethylene glycol.

(vi) Silicone oils and silicone surfactants as described in Lin et al., U.S. Pat. No. 5,174,911 and Lin et al. Ser. No. 07/776,719, herein incorporated by reference.

These softeners are more definitively described in U.S. Pat. No. 4,134,838 the disclosure of which is incorporated by reference herein. Preferred fabric softeners for use herein are acyclic quaternary ammonium salts, di(hydrogenated)tallowdimethyl ammonium methylsulfate is most preferred for dryer articles of this invention.

The amount of the fabric softening composition on the sheet is subject to normal coating parameters such as, for example, viscosity and melting point of the fabric softening component and is typically about 0.5 grams to about 5 grams, preferably about 1 gram to about 3.5 grams. The fabric conditioning composition employed in the present invention contains about 0.1% to about 95% of the fabric softening component. Preferably form about 10% to about 80% and most preferably from about 30% to about 70% of the fabric softening component is employed herein to obtain optimum softening at minimum cost. When the fabric softening component includes a quaternary ammonium salts, the salt is used in the amount of about 10% to about 80%, preferably about 30% to about 70%.

OTHER OPTIONAL FABRIC CONDITIONING INGREDIENTS

Other optional ingredients which can be included in fabric conditioning compositions of the present invention in their conventional levels include optical brighteners or fluorescent agents, colorants, germicides perfumes (which are unencapsulated) and bactericides. The general level of use of any such ingredients is 0 to about 10%; preferably 0.1 to 2 wt. %.

TUMBLE DRYER ARTICLE

In the preferred embodiment, the conditioning composition of the present invention may be coated onto a flexible substrate which carries a fabric conditioning amount of the composition and is capable of releasing the composition at dryer operating temperatures. The conditioning composition in turn has a preferred melting (or softening) point of about 25° C. to about 150° C.

The fabric conditioning composition which may be employed in the invention Is coated onto a dispensing means which effectively releases the fabric conditioning composition in a tumble dryer. Such dispensing means can be designed for single usage or for multiple uses. One such multi-use article comprises a sponge material releasably enclosing enough of the conditioning composition to effectively impart fabric softness during several drying cycles. This multi-use article can be made by filling a porous sponge with the composition. In use, the composition melts and leaches out through the pores of the sponge to soften and condition fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the composition and sealed with a hardened plug of the mixture. The action and heat of the dryer opens the bag and releases the composition to perform its softening.

A highly preferred article comprises the inventive compositions releasably affixed to a flexible substrate such as a sheet of paper or woven or non-woven cloth substrate. When such an article is placed in an automatic laundry dryer, the heat, moisture, distribution forces and tumbling action of the dryer removes the composition from the substrate and deposits it on the fabrics.

The sheet conformation has several advantages. For example, effective amounts of the compositions for use in conventional dryers can be easily absorbed onto and into the sheet substrate by a simple dipping or padding process. Thus, the end user need not measure the amount of the composition necessary to obtain fabric softness and other benefits. Additionally, the flat configuration of the sheet provides a large surface area which results in efficient release and distribution of the materials onto fabrics by the tumbling action of the dryer.

The substrates used in the articles can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

It is known that most substances are able to absorb a liquid substance to some degree; however, the term "absorbent", as used herein, is intended to mean a substrate with an absorbent capacity (i.e., a parameter representing a substrates ability to take up and retain a liquid) from 4 to 12, preferably 5 to 7 times its weight of water.

If the substrate is a foamed plastics material, the absorbent capacity is preferably in the range of 15 to 22, but some special foams can have an absorbent capacity in the range from 4 to 12.

Determination of absorbent capacity values is made by using the capacity testing procedures described in U.S. Federal Specifications (UU-T-595b), modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., Kraft or bond having a basis weight of about 32 pounds per 3,000 square feet) has an absorbent capacity of 3.5 to 4; commercially available household one-ply towel paper has a value of 5 to 6; and commercially available two-ply household toweling paper has a value of 7 to about 9.5.

Suitable materials which can be used as a substrate in the invention herein include, among others, sponges, paper, and woven and non-woven cloth, all having the necessary absorbency requirements defined above.

The preferred non-woven cloth substrates can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e. an array of fibers in a carded web wherein partial orientation of the fibers is frequently present, as well as a completely haphazard distributional orientation), or substantially aligned. The fibers or filaments can be natural (e.g. wool, silk, jute, hemp, cotton, linen, sisal, or ramie) or synthetic (e.g. rayon, cellulose ester, polyvinyl derivatives, polyolefins, polyamides, or polyesters).

The preferred absorbent properties are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a composition by means of intersectional or capillary action. Thus, any thickness necessary to obtain the required absorbent capacity can be used.

When the substrate for the composition is a non-woven cloth made from fibers deposited haphazardly or in random array on the screen, the articles exhibit excellent strength in all directions and are not prone to tear or separate when used in the automatic clothes dryer.

Preferably, the non-woven cloth is water-laid or air-laid and is made from cellulosic fibers, particularly from regenerated cellulose or rayon. Such non-woven cloth can be lubricated with any standard textile lubricant. Preferably, the fibers are from 5 mm to 50 mm in length and are from 1.5 to 5 denier. Preferably, the fibers are at least partially oriented haphazardly, and are adhesively bonded together with a hydrophobic or substantially hydrophobic binder-resin. Preferably, the cloth comprises about 70% fiber and 30% binder resin polymer by weight and has a basis weight of from about 18 to 45g per square meter.

In applying the fabric conditioning composition to the absorbent substrate, the amount impregnated into and/or coated onto the absorbent substrate is conveniently in the weight ratio range of from about 10:1 to 0.5:1 based on the ratio of total conditioning composition to dry, untreated substrate (fiber plus binder). Preferably, the amount of the conditioning composition ranges from about 5:1 to about 1:1, most preferably from about 3:1 to 1:1, by weight of the dry, untreated substrate.

According to one preferred embodiment of the invention, the dryer sheet substrate is coated by being passed over a rotogravure applicator roll. In its passage over this roll, the sheet is coated with a thin, uniform layer of molten fabric softening composition contained in a rectangular pan at a level of about 15 g/square yard. Passage of the substrate over a cooling roll then solidifies the molten softening composition to a solid. This type of applicator is used to obtain a uniform homogeneous coating across the sheet.

Following application of the liquefied composition, the articles are held at room temperature until the composition substantially solidifies. The resulting dry articles, prepared at the composition substrate ratios set forth above, remain flexible; the sheet articles are suitable for packaging in rolls. The sheet articles can optionally be slitted or punched to provide a non-blocking aspect at any convenient time if desired during the manufacturing process.

The fabric conditioning composition employed in the present invention includes certain fabric softeners which can be used singly or in admixture with each other.

EXAMPLES

The following examples illustrate without limitation the present invention.

EXAMPLE 1

The following three formulations were prepared:

| INGREDIENTS | PERCENT BY WEIGHT | |
|---|---|---|
| Di-hydro-tallow dimethyl ammonium methyl sulfate[1] | 47.25 | 44.625 |
| Fatty acid consisting of 45% stearic acid/55% palmitic acid[2] | 20.25 | 19.125 |
| Glycerol monostearate | 22.5 | 21.250 |
| Perfume capsules[3] | 10% | 15 |
| Free water | −0% | 0% |

[1]A quaternary compound supplied as Varisoft 137 by Sherex.
[2]Fatty acid supplied as Emersol 132 by Emery Company.
[3]Perfume capsules containing 40% of a top, middle and bottom note containing perfume (FSR3) encapsulated in a water soluble starch derived from waxy maize known as Purity Gum Be supplied by National Starch and Chemical Corporation of Bridgewater, New Jersey.

The water soluble capsules were prepared by heating to 150° F. 3 lbs. of water with vigorous agitation. While maintaining the temperature at 150° F., agitation was continued as 0.6 lbs. of the Purity Gum Be starch was added. The solution was cooled to 120° F. and 0.4 lbs. of perfume were added with agitation. The resulting mixture was homogenized and the resultant emulsion was spray-dried in a Bowen Conical bed. The spray-drier was fitted with a disc atomizer operating at 20,000 to 22,000 RPM. The inlet and outlet temperatures were 400° F. and 180° F., respectively. The resulting capsules had 40% total perfume oil content.

The quaternary component, fatty acid and glycerol monostearate were combined and mixed in a closed glass container at 80° C. After the mixture became a homogeneous molten solution the perfume capsules were added and mixed thoroughly using a magnetic stir-bar. The formulation was then coated onto 9" by 11" polyester substrates with an in-house kiss-coater manufactured by Lyon Co., N.J. The amount of formulation coated onto each sheet was 1.6 (Sheet A), 2.1 (Sheet B) 2.6 grams (Sheet C. The sheets were dried at 110° F.

Each dryer sheet was placed in a Lady Kenmore Heavy Duty dryer with a mixed load of polyester cotton sheetings and cotton diapers weighing approximately 2.7 kilograms of fabrics. As a control, a dryer sheet was coated with the foregoing formulation without the perfume capsules.

A perfume panel evaluated fabrics dried with the dryer sheets containing 10 wt. % and wt. 15% perfume capsules (Sheets A and C) versus fabrics dried with sheets containing no perfume. The panelists scored the presence of perfume from 0 (no smell) to 5 (very strong perfume smell). The results are tabulated below.

TABLE I

| | 10 wt. % FSR3 capsule | | | 15 wt. % FSR3 capsule | | |
|---|---|---|---|---|---|---|
| Dryer Sheets | Control | Dry | Wet | Control | Dry | Wet |
| A | 0 | 1.1 | 1.4 | 0 | 1.5 | 2.1 |
| C | 0 | 1.5 | 1.3 | 0 | 1.7 | 2.7 |

The panelists gave a statistically higher average score (strong perfume smell) to fabrics dried with the perfume particle containing sheet, Furthermore, the average score from moistened fabric was higher than the one without moisture,

EXAMPLE 2

Dryer sheets were coated with a formulation prepared as described in Example 1 except that the perfume encapsulated in the capsules consisted of only top notes (FSR3-top note).

In a controlled test according to the protocol of Example 1, panelists results are as follows:

TABLE 2

| | 10 wt. % FSR3 topnote capsule | | | 15 wt. % FSR3 topnote capsule | | |
|---|---|---|---|---|---|---|
| Sheets | Control | Dry | Wet | Control | Dry | Wet |
| A | 0 | 0.8 | 1.6 | 0 | 0.9 | 2.1 |
| C | 0 | 0.5 | 2.3 | 0 | 0.7 | 2.3 |

The panelists gave a statistically higher average score (strong perfume smell) to fabrics dried with the perfume particle containing sheet. Furthermore, the average score from moistened fabric was higher than the one without moisture.

EXAMPLE 3

Dryer sheets containing the following composition were prepared as follows:

| INGREDIENTS | PERCENT BY WEIGHT | | | |
|---|---|---|---|---|
| Di-hydro-tallow dimethyl ammonium methyl sulfate[1] | 65.86 | 64.51 | 63.17 | 61.82 |
| Fatty acid consisting of 45% | 28.22 | 27.65 | 27.07 | 26.50 |

-continued

| INGREDIENTS | PERCENT BY WEIGHT | | | |
|---|---|---|---|---|
| stearic acid/55% palmitic acid[2] | | | | |
| Fumed silica[3] | 3.92 | 3.84 | 3.76 | 3.68 |
| Perfume capsules[4] | 2 | 4 | 6 | 8 |
| Free water | -0- | -0- | -0- | -0- |

[1]Supplied as Varisoft 137 by Sherex.
[2]Fatty acid supplied as Emersol 132 by Emery Co.
[3]Silica supplied by Cabot Company of Massachusetts.
[4]Perfume capsules containing 40% of a perfume containing top notes (FSR3-SE) were encapsulated in the water soluble starch derived from waxy maize known as Purity Gum Be supplied by National Starch and Chemical Corporation of Bridgewater, New Jersey as described in Example 1.

The foregoing formulations were prepared as described in Example 1 and coated onto 9×11" polyester sheets so that 2.1 and 2.6 grams of formulation were contained on sheets B and Sheets C, respectively.

Sheets containing no perfume were prepared as described above and used as controls.

Fabrics were washed with both the perfume capsule containing dryer sheet and the control sheets and the panelists results are as follows:

TABLE 3

| Dryer Sheets | Control | 2 wt. % | | 4 wt. % | | 6 wt. % | | 8 wt. % | |
|---|---|---|---|---|---|---|---|---|---|
| | | Dry | Wet | Dry | Wet | Dry | Wet | Dry | Wet |
| B | 0 | 0.3 | 0.4 | 0.5 | 0.5 | 0.6 | 0.8 | 0.6 | 1.2 |
| C | 0 | 0.5 | 0.6 | 0.4 | 1.1 | 0.7 | 1.5 | 0.9 | 1.5 |

The panelists gave a statistically higher average score (strong perfume smell) to fabrics dried with the perfume particle containing sheet. Furthermore, the average score from moistened fabric was higher than the one without moisture.

EXAMPLE 4

The perfume capsules described in Example 3 were mixed with various amounts of water (ranging from 0 to 10 wt. % water) and a 70 to 30 weight ratio mixture of Di-hydro-tallow dimethyl ammonium methyl sulfate (a quaternary compound supplied as Varisoft 137 by Sherex) and Fatty acid (supplied as Emersol 132 by Emery Company) and the concentration of perfume in the head space when using a gas chromatography purge and trap technique was measured.

As a control, nonencapsulated perfume without the presence of water was measured by using the gas chromatography purge and trap technique.

The following perfume peak areas were determined:

TABLE 4

| | | | | | |
|---|---|---|---|---|---|
| wt. % of perfume capsule | 0 | 10 | 10 | 10 | 10 |
| wt. % of perfume | 4 | 0 | 0 | 0 | 0 |
| wt. % of water | 0 | 10 | 5 | 2.5 | 0 |
| Total perfume peak area | 231523 | 180447 | 99665 | 67357 | 23233 |
| (Total perfume peak area)/(Total non-encapsulated perfume peak area) | 1.00 | 0.78 | 0.43 | 0.29 | 0.10 |

The gas chromatography purge and trap technique is used by purging the samples with nitrogen and measuring the vapor pressure above the head space of each sample at 80° C. As described in V. Loffe and A. G. Vitenberg, "Head space analysis and related methods in gas chromatography", John Wiley & Sons, 1984.

The total perfume peak area measured with the purge and trap technique was calculated as total perfume peak area over total non-encapsulated perfume peak area to obtain a normalized gas chromatography head space peak area relative to the head space area of non-encapsulated perfume.

As seen above, 10 wt. % of water dissolves much of the water soluble starch capsule and the perfume release rate was only 78% of the non-encapsulated perfume. When the water percentage is reduced to 5 wt. %, the perfume release rate was less than half of that from non-encapsulated perfume. Reduced further to 2.5 wt. % water, the perfume release rate was reduced to only 29% of that from non-encapsulated perfume.

Thus, fabric conditioning formulations containing less than about 10 wt. % of water, preferably less than about 5 wt. % of water, retain a significant amount of perfume which is deposited on dried fabrics and will be released upon with an aqueous trigger upon use or wear of the fabrics.

EXAMPLE 5

Dryer sheets were prepared as described in Example 3 and fabrics were dried with the sheets according to the procedure of Example 1.

As a control, 30% of a perfume containing top notes (FSR3-SE) was encapsulated in a coating containing 35 wt. % Purity Gum Be and 35 wt. % R5466-53, a relatively water insoluble starch to form the perfume capsules, Both starches were supplied by National Starch and Chemical Corporation of Bridgewater, N.J. The perfume capsules were incorporated into the fabric conditioning formulation described in Example 3.

Panelists evaluated both fabrics dried with the dryer sheet containing perfume encapsulated in the water soluble capsules according to the invention, and fabrics dried with a dryer sheet containing perfume encapsulated in the starch mixture outside of the invention.

Panelists evaluated the fabrics first dry and then after wetting with water sprayed from a spray container onto the fabrics.

Panelists found little perfume difference on fabrics dried with sheets outside of the invention both before and after wetting with the aqueous trigger.

In contrast, panelists found a significant difference in the fabrics dried with the dryer sheets according to the invention after rewetting with the aqueous trigger. Panelists detected more than twice the amount of perfume strength in rewetted fabrics as opposed to fabrics which were dried out of the tumble dryer.

Therefore, the perfume capsule containing sheets of the invention provide a significant release of perfume delayed until acted upon by an aqueous trigger.

We claim:

1. A tumble dryer article comprising:

a) an effective amount of a fabric conditioning composition comprising (i) from about 60 to about 99 wt. % of a hydrocarbon based fabric conditioning component; and (ii) 0.5 wt. % to 30 wt. % perfume capsules consisting essentially of a water soluble natural, modified natural or synthetic polymer, 1% to 70% perfume, and water, the perfume capsules formed by mixing the polymer and the water to form a solution, adding the perfume to the solution to form an emulsified mixture and either spray drying or coacervating the emulsified mixture, the fabric conditioning composition having 10 wt. % or less free water when 0.5 wt. % to 10 wt. % perfume capsules are present and a free water to perfume capsules ratio of less than about 1 when more than 10 wt. % perfume capsules are present; and b) dispensing means for dispensing the fabric conditioning composition onto fabrics in a tumble dryer, to form a tumble dryer article which initially releases perfume when triggered by an aqueous trigger and again releases perfume when rewetted by another aqueous trigger.

2. A tumble dryer article according to claim 1 wherein the fabric conditioning composition comprises less than about 5 wt. % free water when the composition contains the 0.5 wt. % to 10 wt. % perfume capsules.

3. A tumble dryer article according to claim 2 wherein the fabric conditioning composition comprises less than about 3 wt. % free water when the composition contains the 0.5 wt. % to 10 wt. % perfume capsules.

4. A tumble dryer article according to claim 1 wherein the water soluble natural polymer of the perfume capsule is selected from the group consisting of starch, gum and gelatin.

5. A tumble dryer article according to claim 4 wherein the starch is a hydrophobically modified starch.

6. A tumble dryer article according to claim 1 wherein the perfume capsules are present in an amount of about 5 to about 10 wt. % and the free water is present in an amount of less than about 5 wt. %.

7. A tumble dryer article according to claim 1 wherein the fabric conditioning component is selected from the group consisting of a cationic quaternary ammonium salt, a tertiary fatty amine having at least one $C_8$–$C_{30}$ alkyl chain, a carboxylic acid having 8 to 30 carbon atoms and one carboxylic group per molecule, an ester of a polyhydric alcohol, a fatty alcohol, an ethoxylated fatty alcohol, an alkylphenol, an ethoxylated alkylphenol, an ethoxylated fatty amine, an ethoxylated monoglyceride, an ethoxylated diglyceride, a mineral oil, a silicon oil, a silicon surfactant, a polyol and mixtures thereof.

8. A tumble dryer article according to claim 1 wherein the dispensing means is a flexible substrate.

9. A method of conditioning fabrics comprising the steps of:

a) selecting a tumble dryer article comprising an effective amount of a fabric conditioning composition comprising:

(i) from about 60 to about 99 wt. % of a hydrocarbon based fabric conditioning component; and (ii) 0.5 wt. % to 30 wt. % perfume capsules consisting essentially of a water soluble natural, modified natural or synthetic polymer, 1% to 70% perfume and water, the perfume capsules formed by mixing the polymer and water to form a solution, adding the perfume to the solution to form an emulsified mixture and either spray drying or coacervating the emulsified mixture.

the fabric conditioning composition having 10 wt. % or less free water when 0.5 wt. % to 10 wt. % perfume capsules are present and a free water to perfume capsules ratio of less than about 1 when more than 10 wt. % perfume capsules are present to form a tumble dryer article which initially releases perfume when triggered by an aqueous trigger and again releases perfume when rewetted by another aqueous trigger; and b) contacting the tumble dryer article with fabrics in a tumble dryer until the fabrics are substantially dry.

10. A process according to claim 9 wherein the process step b further comprises applying an aqueous trigger to the fabrics dried in step (b) to release additional perfume from the perfume capsules so that the perfume capsules contain less than about 30% perfume.

* * * * *